US011039654B2

(12) United States Patent
Hsu

(10) Patent No.: US 11,039,654 B2
(45) Date of Patent: Jun. 22, 2021

(54) PROTECTIVE MASK

(71) Applicant: Shih-Huang Hsu, Tainan (TW)

(72) Inventor: Shih-Huang Hsu, Tainan (TW)

( * ) Notice: Subject to any disclaimer, the term of this patent is extended or adjusted under 35 U.S.C. 154(b) by 683 days.

(21) Appl. No.: 15/904,709

(22) Filed: Feb. 26, 2018

(65) Prior Publication Data

US 2019/0261723 A1 Aug. 29, 2019

(51) Int. Cl.

| | |
|---|---|
| ***A42B 3/20*** | (2006.01) |
| ***A63B 71/10*** | (2006.01) |
| ***A63B 69/02*** | (2006.01) |

(52) U.S. Cl.

CPC ..... *A42B 3/20* (2013.01); *A63B 71/10* (2013.01); *A63B 69/02* (2013.01); *A63B 2071/105* (2013.01)

(58) Field of Classification Search

CPC .. A42B 3/20; A42B 3/18; A42B 3/205; A63B 71/10; A63B 69/02; A63B 2071/105

USPC ..... 2/9, 424

See application file for complete search history.

(56) References Cited

U.S. PATENT DOCUMENTS 5,384,914 A * 1/1995 Caveness ..... A42B 3/20 2/424

2016/0346662 A1* 12/2016 Hsu ..... A63B 71/10

* cited by examiner

*Primary Examiner* — Jameson D Collier
*Assistant Examiner* — F Griffin Hall

(57) ABSTRACT

A protective mask includes a main frame body made of magnesium alloy and having an imaginary vertical central line. The main frame body has a plurality of first rods arranged along the central line, a plurality of second rods, and at least one first protrusion. Each of the first rods has spaced-apart first front and rear surfaces, and two opposite first connecting surfaces interconnecting the first front and rear surfaces. A thickness between the first front and rear surfaces is larger than a thickness between the first connecting surfaces. Each of the second rods is connected between two adjacent ones of the first rods. The first protrusion protrudes from the first front surface of one of the first rods.

8 Claims, 8 Drawing Sheets

PROTECTIVE MASK

FIELD

The disclosure relates to a mask, and more particularly to a protective mask for protecting face of a user.

BACKGROUND

Generally, athletes such as baseball catchers, softball catchers, kendo players and the like often wear protective masks around their heads to protect their heads and faces from injuries.

Referring to FIGS. 1 to 3, a conventional protective mask 1 is usually worn in front of a user's face by use of a buffered protector (not shown). The conventional protective mask 1 is molded as one piece from plastic material, and includes a surrounding frame body 11 and a main frame body 12 that is molded as one piece with the surrounding frame body 11. The main frame body 12 has a plurality of rod portions 120 that are curved and that cooperate with each other to fittingly match the user's face. Each of the rod portions 120 has a front surface 121, a rear surface 122 opposite to the front surface 121, and two opposite and spaced-apart connecting surfaces 123 interconnecting the front and rear surfaces 121, 122. A thickness 125 between the front and rear surfaces 121, 122 is smaller than a thickness 124 between the connecting surfaces 123.

The conventional protective mask 1 is made of plastic material for the sake of reducing weight. However, to ensure structural strength of the conventional protective mask 1, each of the rod portions 120 and the surrounding frame body 11 are required to be sufficiently thick, especially at the rod portions 120, where a ball (see FIG. 3) directly strikes thereon. As a result, the overall weight of the conventional protective mask cannot be effectively reduced. Furthermore, due to the configuration of the rod portions 120, a distance between two adjacent ones of the rod portions 120 is shortened, so that the user's visual sight may be adversely affected.

SUMMARY

Therefore, an object of the disclosure is to provide a protective mask that can alleviate at least one of the drawbacks associated with the abovementioned prior art.

Accordingly, the mask includes a main frame body that is made of magnesium alloy and that has an imaginary vertical central line. The main frame body has a plurality of spaced-apart first rods, a plurality of second rods, and at least one first protrusion. The first rods are arranged along the central line. Each of the first rods has a first front surface, a first rear surface that is spaced apart from the first front surface in a front-rear direction, and two opposite first connecting surfaces that interconnect the first front surface and the first rear surface. A thickness between the first front surface and the first rear surface is larger than a thickness between the first connecting surfaces. Each of the second rods is connected between two adjacent ones of the first rods. The first protrusion protrudes from the first front surface of one of the first rods.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
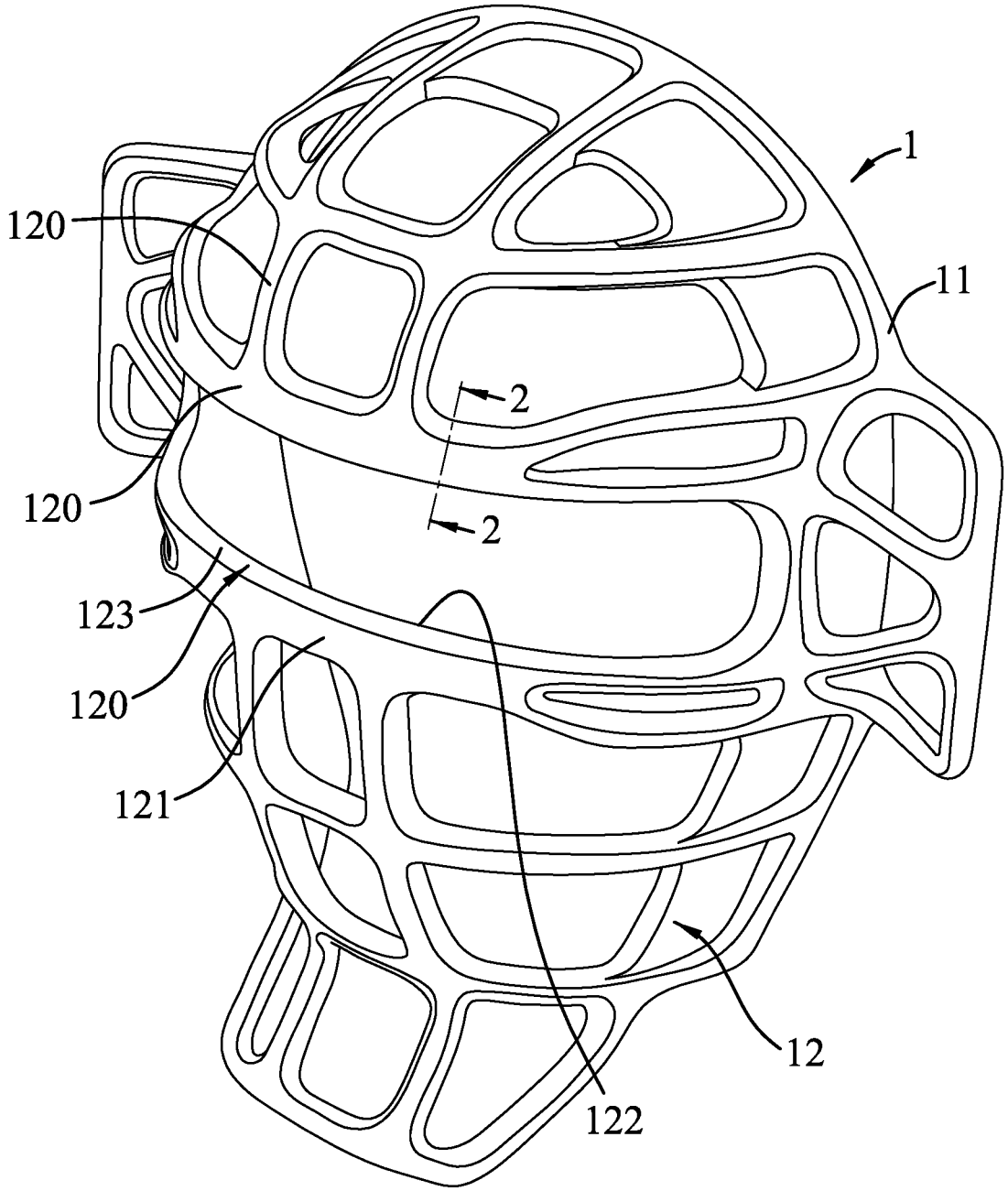
FIG.1 PRIOR ART
FIG. 1 is a perspective view of a conventional protective mask.
Figure 2:
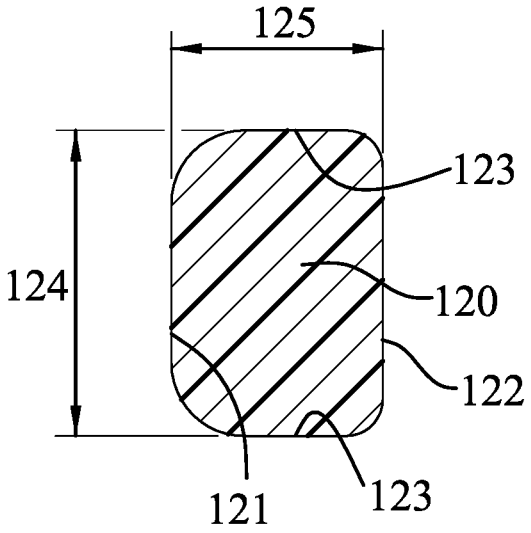
FIG.2 PRIOR ART
FIG. 2 is a sectional view taken along line 2-2 in FIG. 1.
Figure 3:
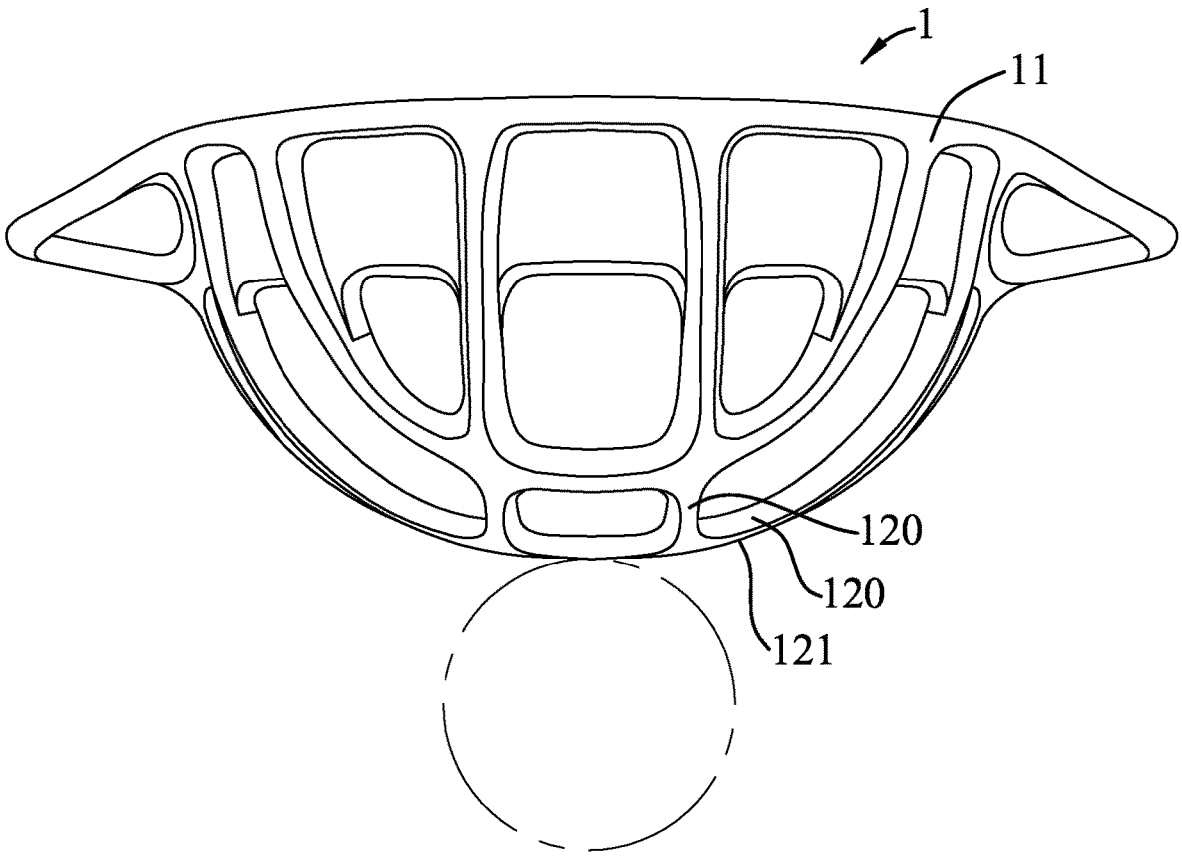
FIG.3 PRIOR ART
FIG. 3 is a schematic top view of the conventional protective mask, illustrating a ball that hits a front surface thereof.
Figure 4:
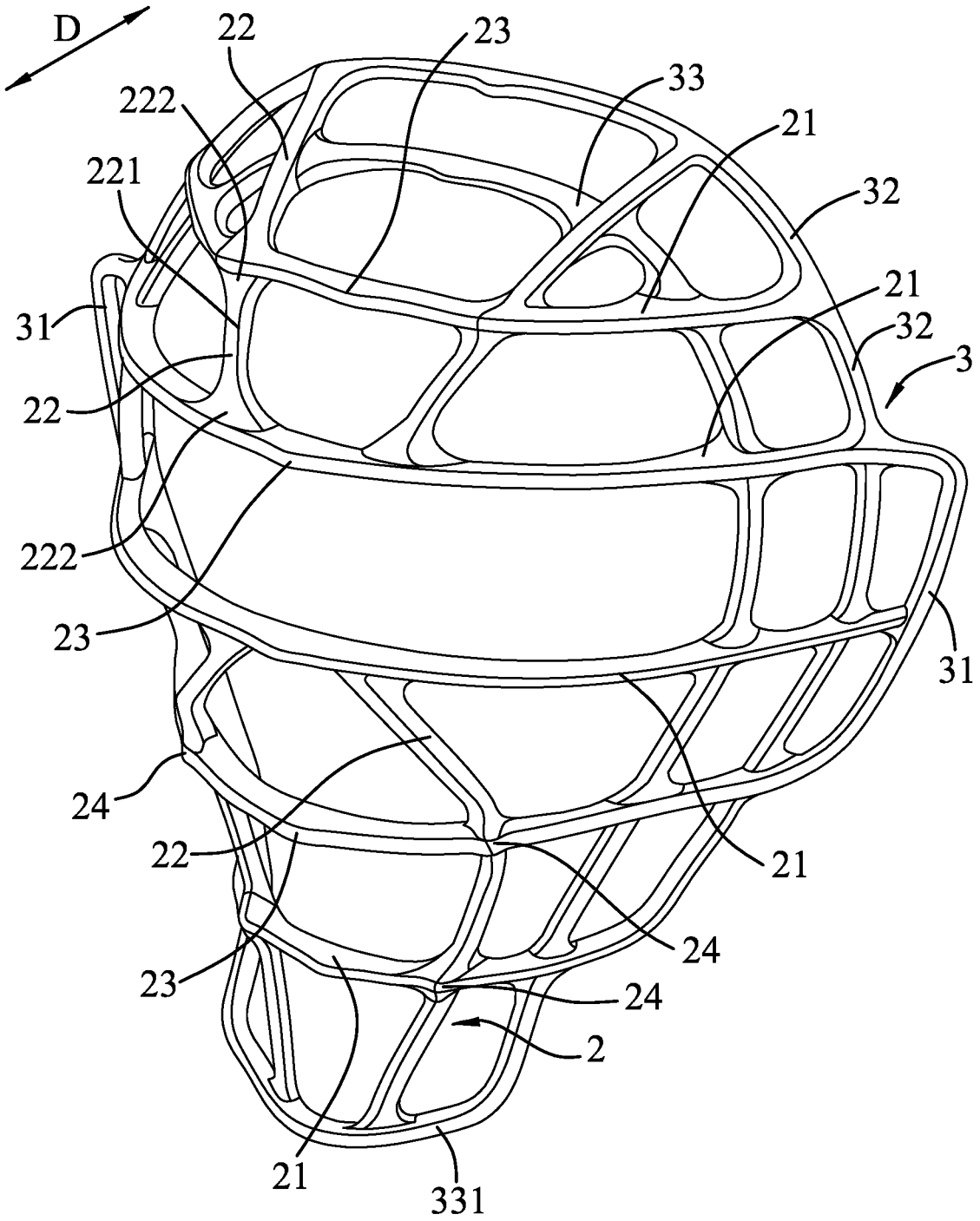
FIG. 4 is a perspective view of an embodiment of a protective mask according to the present disclosure.
Figure 5:
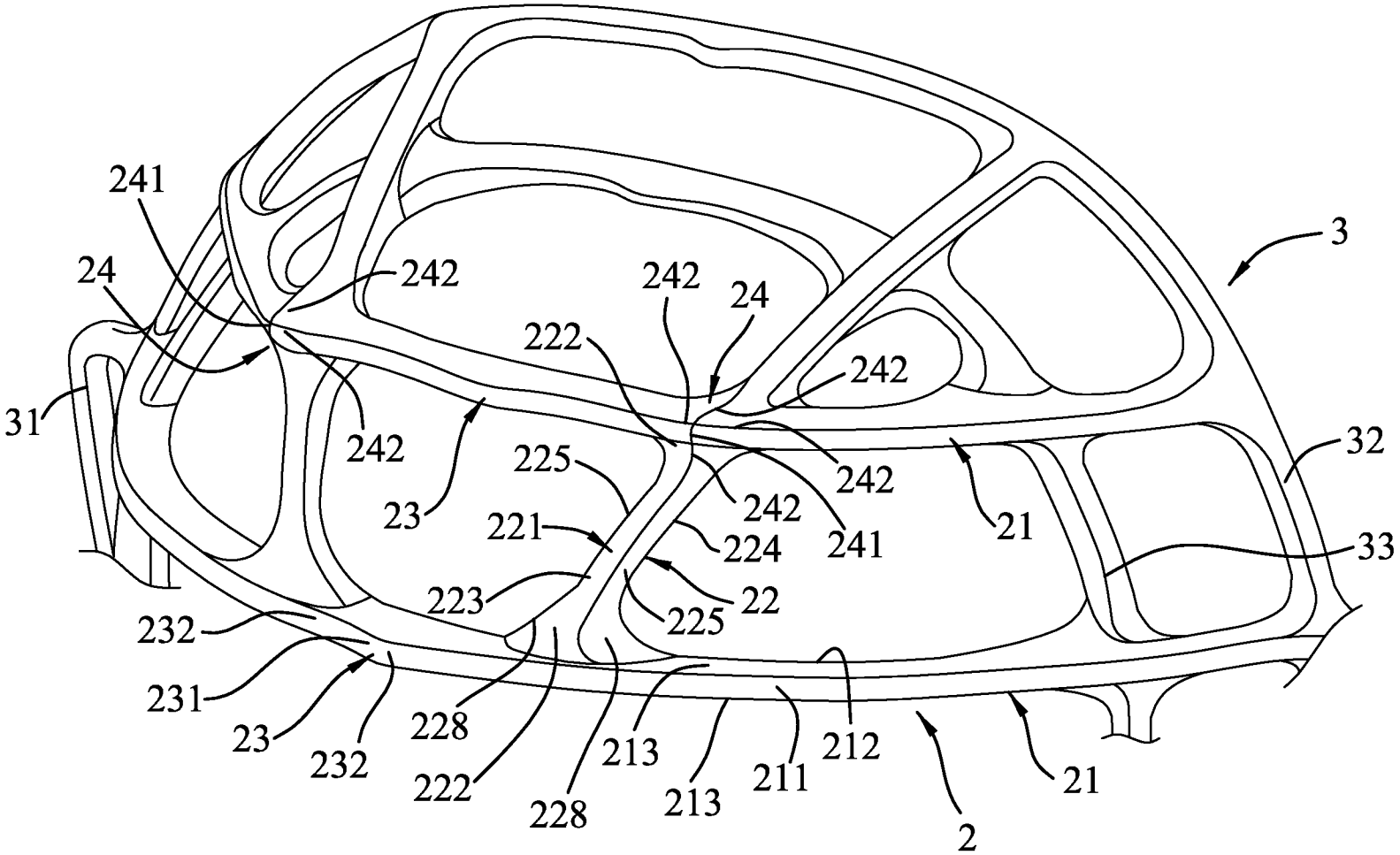
FIG. 5 is a fragmentary perspective view of the embodiment.
Figure 6:
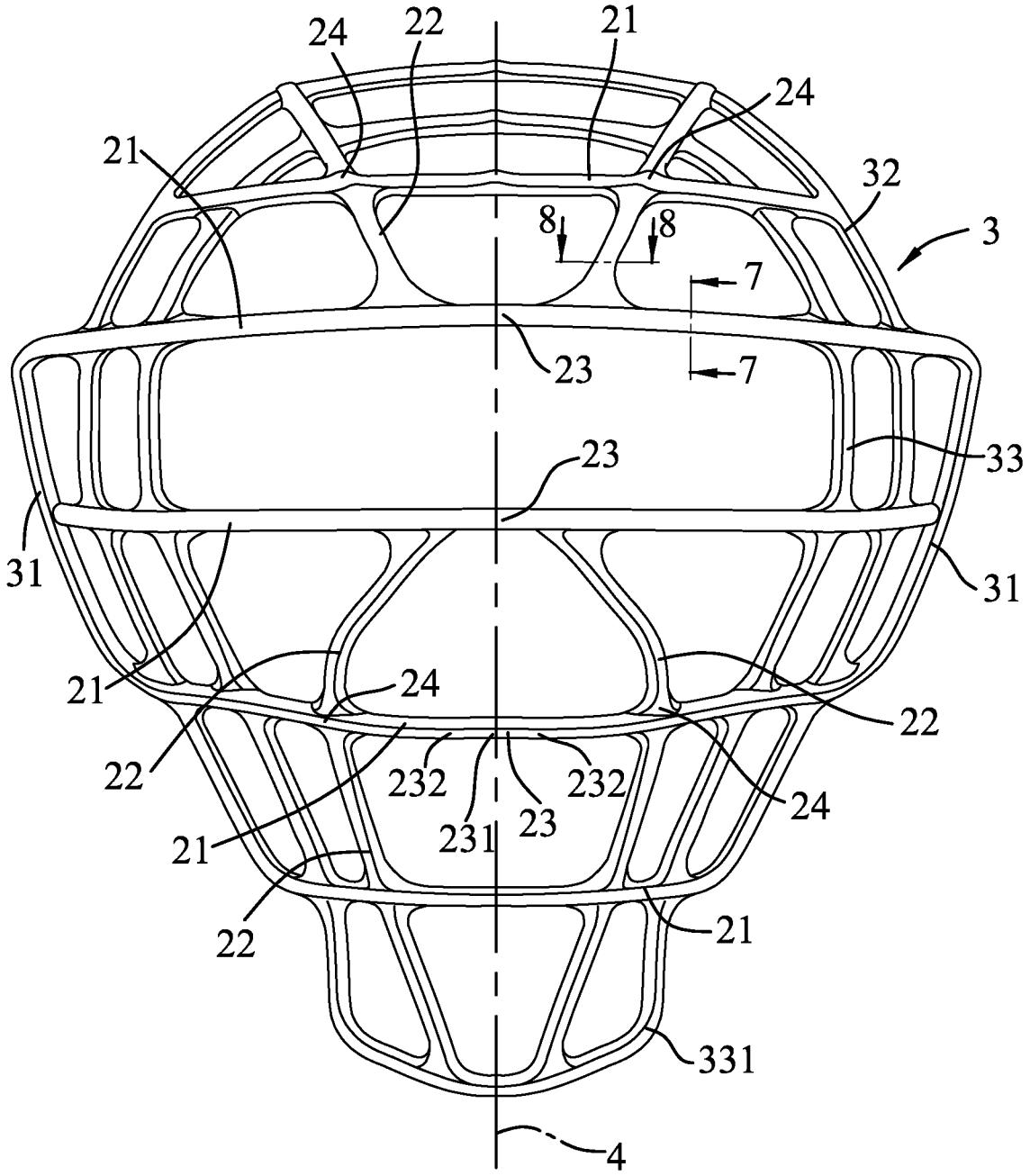
FIG. 6 is a front view of the embodiment.

Referring to FIGS. 4 to 6, an embodiment of a protective mask according to the present disclosure is adapted to be integrated with a buffered protector (not shown) which is worn around a user's head. The protective mask is molded as one piece via a semi-solid metal casting process, and is preferably made of magnesium alloy. The protective mask includes a main frame body 2 and a surrounding frame unit 3 that are molded as one piece with each other, and that have an imaginary vertical line 4. The main frame body 2 has a plurality of spaced-apart first rods 21 that are arranged along the central line 4, and a plurality of second rods 22, each of which is connected between two adjacent ones of the first rods 21.

Each of the first rods 21 is configured to be curved for corresponding in shape with the user's face, and has a flat cross-section. In this embodiment, the main frame body 21 has five first rods 21, but the number of the first rod 21 may vary in other embodiments. As shown in FIG. 6, the uppermost first rod 21 and the lowermost first rod 21 is shorter in length than the remaining three first rods 21.

Figure 7:
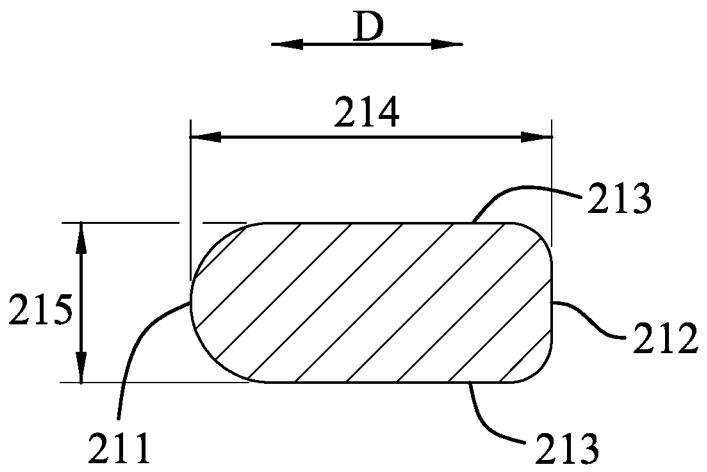
FIG. 7 is a sectional view taken along line 7-7 in FIG. 6.
Figure 8:
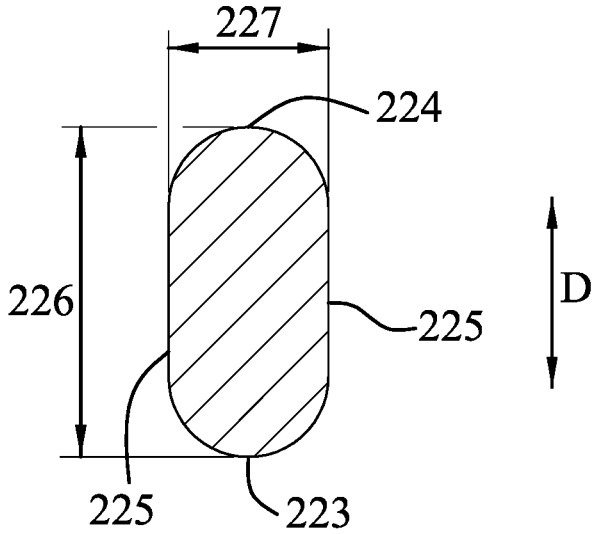
FIG. 8 is another sectional view taken along line 8-8 in FIG. 6.

Referring to FIGS. 5, 7 and 8, each of the first rods 21 has a first front surface 211, a first rear surface 212 that is spaced apart from the first front surface 211 in a front-rear direction (D) (see also FIG. 4), and two opposite first connecting surfaces 213 that interconnect the first front surface 211 and the first rear surface 212. A thickness 214 between the first front surface 211 and the first rear surface 212 gradually reduces toward the surrounding frame unit 3 from the central line 4 (see FIG. 6). The thickness 214 between the first front and rear surfaces 211, 212 is larger than a thickness 215 between the first connecting surfaces 213.

In this embodiment, each of the second rods 22 of the main frame body 2 has a flat cross-section, and is arranged symmetrically with respect to the central line 4. Each of the second rods 22 has a middle section 221 and two coupling sections 222 that respectively extend from opposite ends of the middle section 221. The middle section 221 has a second front surface 223, a second rear surface 224 that is spaced apart from the second front surface 223 in the front-rear direction (D), and two opposite second connecting surfaces 225 that interconnect the second front surface 223 and the second rear surface 225. A thickness 226 between the second front surface 223 and the second rear surface 224 is larger than a thickness 227 between the second connecting surfaces 225. Each of the coupling sections 222 has two opposite curved edges 228, each of which has a size that is enlarged toward an adjacent one of the first rods 21, and is connected to the adjacent one of the first rods 21.

Referring to FIGS. 5 and 6, the main frame body 2 further has at least one first protrusion 23 and a plurality of second protrusions 24. It should be noted that, in this embodiment, the main frame body 2 has five first protrusions 23, but the number of the first protrusion 23 may vary in other embodiments. Each of the first protrusions 23 is disposed on a respective one of the first rods 21. Specifically, each the first protrusions 23 protrudes from the first front surface 211 of the respective one of the first rods 21. Each of the first protrusions 23 has a first protruding portion 231 that is proximate to the central line 4 of the main frame body 2, and two opposite first inclined surfaces 232 that are located respectively at two opposite sides of the first protruding portion 231. Each of the first inclined surfaces 232 extends slantingly from the first protruding portion 231 toward the first front surface 211 of a corresponding one of the first rods 21. Preferably, the first protruding portion 231 of each of the first protrusions 23 is substantially positioned on the central line 4 of the main frame body 2.

In this embodiment, each of the first rods 21 is formed with two of the second protrusions 24 that are symmetrical with respect to the central line 4 of the main frame body 2. Each of the second protrusions 24 is positioned at a junction between a corresponding one of the first rods and two corresponding ones of the second rods 22. Each of the second protrusions 24 has a second protruding portion 241 protruding forwardly, and four second inclined surfaces 242 located respectively at opposite sides of the second protruding portion 241. Each of the second inclined surfaces 242 extend to one of a corresponding one of the first rods 21 and a corresponding one of the second rods 22.

In this embodiment, the surrounding frame unit 3 surrounds the main frame body 2, and has two extension frames 31 opposite to each other with respect to the central line 4, an outer surrounding frame 32 molded as one piece with the extension frames 31 and the main frame body 2, and an inner surrounding frame 33 spaced apart from the outer surrounding frame 32 and having a lower frame portion 331 that is disposed at a lower end thereof and that is adapted for corresponding in position to the user's neck (or lower facial area). It should be noted that the configuration of the surrounding frame unit 3 may vary in other embodiments.

Figure 9:
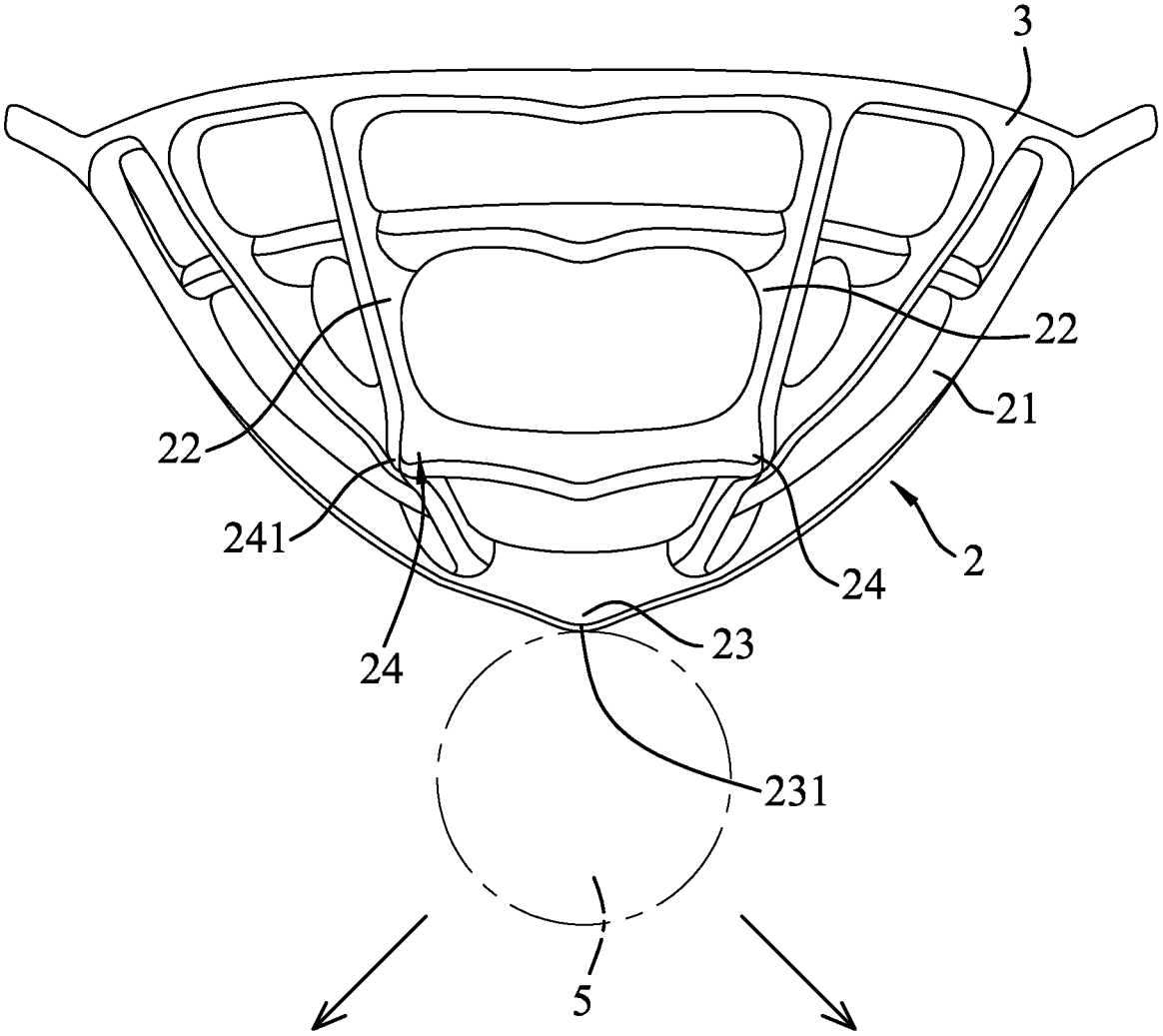
FIG. 9 is a schematic top view of the embodiment, illustrating one of a plurality of first protrusions that is adapted to be hit by a ball.

Referring to FIG. 9, in use, the embodiment of the protective mask of the present disclosure is worn on the user's face (not shown). In comparison with the aforesaid conventional protective mask 1, when a ball 5 hits on one of the first and second rods 21, 22, since each of the first rods 211 has the larger thickness 214 between the first front and rear surfaces 211, 212 and since each of the second rods 22 has the larger thickness 226 between the second front and rear surfaces 223, 224, the main frame body 2 of the embodiment of the protective mask can withstand significant impact of the ball 5. In addition, the embodiment of the protective mask of the present disclosure being molded as one piece from the magnesium alloy provides enhanced protection than the conventional protective mask made of plastic. Due to the configuration of the main frame body 2 of the present disclosure, the first and second rods 21, 22 are not required to be thick, so that the overall weight of the embodiment of the protective mask can be reduced, and a distance between two adjacent ones of the first rods 21 and a distance between two adjacent ones of the second rods 22 can be enlarged for better visual sight of the user.

Furthermore, when the ball 5 hits on one of the first and second protrusions 23, 24 at a rapid speed, by virtue of the structural design of the first protruding portion 231 of each of the first protrusions 23 and the second protruding portion 241 of each of the second protrusions 24, a striking direction of the ball 5 may immediately swerve after being in contact with the first/second protrusions 23, 24, so that stress of the ball 5 is prevented from being concentrated at areas around the first/second protrusions 23, 24.

In the description above, for the purposes of explanation, numerous specific details have been set forth in order to provide a thorough understanding of the embodiment. It will be apparent, however, t one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the di s closure has been described in connection with what is considered the exemplary embodiment, it is understood that his disclosure is not limited to the disclosed embodiment but is intended to cover various arrangements included within the spirit and scope of the broadest interpretation so as to encompass all such modifications and equivalent arrangements.

What is claimed is:

1. A protective mask comprising a main frame body that is made of magnesium alloy, that is molded as one piece, and that has an imaginary vertical central line, said main frame body having:

a plurality of spaced-apart first rods arranged along the central line, each of said first rods having a first front surface, a first rear surface that is spaced apart from said first front surface in a front-rear direction, and two opposite first connecting surfaces that interconnect said first front surface and said first rear surface, a thickness between said first front surface and said first rear surface being larger than a thickness between said first connecting surfaces;

a plurality of second rods, each of which is connected between two adjacent ones of said first rods; and at least one first protrusion protruding from said first front surface of one of said first rod;

said first protrusion having:

a first protruding portion proximate to the central line of said main frame body; and two opposite first inclined surfaces located respectively at two opposite sides of said first protruding portion, each of said first inclined surfaces extending slantingly from said first protruding portion toward said first front surface of a corresponding one of said first rods;

said main frame body having a plurality of said first protrusions, each of which is disposed on a respective one of said first rods; and said first protruding portion of each of said first protrusions substantially positioned on the central line of said main frame body;

said main frame body further having a plurality of second protrusions, each of which is positioned at a junction between a corresponding one of said first rods and two corresponding ones of said second rods; and each of said second protrusions having:

a second protruding portion protruding forwardly; and a plurality of second inclined surfaces located respectively at two opposite sides of said second protruding portion, each of said second inclined surfaces extending to one of a corresponding one of said first rods and a corresponding one of said second rods.

2. The protective mask as claimed in claim 1, wherein:

each of said second rods of said main frame body has a middle section having a second front surface, a second rear surface that is spaced apart from said second front surface in the front-rear direction, and two opposite second connecting surfaces that interconnect said second front surface and said second rear surfaces; and a thickness between said second front surface and said second rear surface is larger than a thickness between said second connecting surfaces.

3. The protective mask as claimed in claim 2, wherein each of said second rods further has two coupling sections respectively extending from opposite ends of said middle section, each of said coupling sections having two opposite curved edges, each of which has a size that is enlarged toward an adjacent one of said first rods, and is connected to the adjacent one of said first rods.

4. The protective mask as claimed in claim 1, wherein each of said first rods is formed with two of said second protrusions that are symmetrical with respect to the central line of said main frame body.

5. The protective mask as claimed in claim 4, further comprising a surrounding frame unit that is molded as one piece with said main frame body, and that surrounds said main frame body.

6. The protective mask as claimed in claim 5, wherein said surrounding frame unit has:

two extension frames opposite to each other with respect to the central line;

an outer surrounding frame molded as one piece with said extension frames and said main frame body; and an inner surrounding frame spaced apart from said outer surrounding frame, said inner surrounding frame having a lower frame portion that is disposed at a lower end of said inner surrounding frame, and said lower frame portion is adapted for corresponding in position to a user's neck.

7. The protective mask as claimed in claim 1, further comprising a surrounding frame unit that is molded as one piece with said main frame body, and that surrounds said main frame body.

8. The protective mask as claimed in claim 7, wherein said surrounding frame unit has:

two extension frames opposite to each other with respect to the central line;

an outer surrounding frame molded as one piece with said extension frames and said main frame body; and an inner surrounding frame spaced apart from said outer surrounding frame, said inner surrounding frame having a lower frame portion that is disposed at a lower end of said inner surrounding frame, and said lower frame portion is adapted for corresponding in position to a user's neck.

* * * * *